US011659337B1

(12) United States Patent
King et al.

(10) Patent No.: US 11,659,337 B1
(45) Date of Patent: May 23, 2023

(54) BALANCED ARMATURE RECEIVER HAVING IMPROVED SHOCK PERFORMANCE

(71) Applicant: Knowles Electronics, LLC, Itasca, IL (US)

(72) Inventors: Charles King, Oak Park, IL (US); Chris Monti, Elgin, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 17/565,351

(22) Filed: Dec. 29, 2021

(51) Int. Cl.

| | |
|---|---|
| ***H04R 11/02*** | (2006.01) |
| ***H04R 1/02*** | (2006.01) |
| ***H04R 7/18*** | (2006.01) |
| ***H04R 7/12*** | (2006.01) |
| ***H04R 1/34*** | (2006.01) |

(52) U.S. Cl.
CPC ..... *H04R 11/02* (2013.01); *H04R 1/025* (2013.01); *H04R 1/345* (2013.01); *H04R 7/12* (2013.01); *H04R 7/18* (2013.01)

(58) Field of Classification Search
CPC ..... H04R 11/02; H04R 1/025; H04R 1/345; H04R 7/12; H04R 7/18
USPC ..... 381/332
See application file for complete search history.

(56) References Cited

U.S. PATENT DOCUMENTS

| | | | | |
|---|---|---|---|---|
| 1,871,739 A | | 8/1932 | Ringel | |
| 2,143,097 A | | 1/1939 | Warneke | |
| 2,994,016 A | | 7/1961 | Tibbetts et al. | |
| 3,111,563 A | | 11/1963 | Carlson | |
| 3,163,723 A | | 12/1964 | Tibbetts | |
| 3,172,022 A | | 3/1965 | Tibbetts | |
| 3,177,412 A | | 4/1965 | Carlson | |
| 3,182,384 A | | 5/1965 | Carlson et al. | |
| 3,347,991 A | | 10/1967 | Carlson | |
| 3,432,622 A | | 3/1969 | Sebesta et al. | |
| 3,531,745 A | | 9/1970 | Tibbetts | |
| 3,588,383 A | | 6/1971 | Carlson et al. | |
| 3,617,653 A | | 11/1971 | Tibbetts et al. | |
| 3,935,398 A | | 1/1976 | Carlson et al. | |
| 4,272,654 A | | 6/1981 | Carlson | |
| 4,410,769 A | | 10/1983 | Tibbetts | |
| 4,425,482 A | * | 1/1984 | Bordelon | H04R 11/02 335/231 |

(Continued)

FOREIGN PATENT DOCUMENTS

| | | | |
|---|---|---|---|
| CN | 1452545 | A | 10/2003 |
| CN | 103364909 | A | 10/2013 |

(Continued)

OTHER PUBLICATIONS

European Patent Office; International Search Report and Written Opinion; International Application No. PCT/US2018/041921; dated Feb. 15, 2019.

*Primary Examiner* — Sean H Nguyen
(74) *Attorney, Agent, or Firm* — Loppnow & Chapa

(57) ABSTRACT

A balanced armature (BA) receiver and specifically a nickel-iron (Ni—Fe) alloy armature having improved robustness and performance receivers, as well as motors and receivers including such armatures are disclosed. The Ni—Fe armature has a nickel content of 45% or less by weight, 5% or less additive and impurities by weight, and the balance Fe. The armature can be configured as a U-reed, an E-reed or in some other configuration.

19 Claims, 3 Drawing Sheets

(56) References Cited

U.S. PATENT DOCUMENTS

| | | | | |
|---|---|---|---|---|
| 4,473,722 | A | 9/1984 | Wilton | |
| 4,518,831 | A | 5/1985 | Stanley et al. | |
| 5,101,435 | A | 3/1992 | Carlson | |
| 5,222,050 | A | 6/1993 | Marren et al. | |
| 5,610,989 | A | 3/1997 | Salvage et al. | |
| 5,647,013 | A | 7/1997 | Salvage et al. | |
| 5,690,093 | A | 11/1997 | Schrank et al. | |
| 5,708,721 | A | 1/1998 | Salvage et al. | |
| 6,041,131 | A | 3/2000 | Kirchhoefer et al. | |
| 6,075,870 | A | 6/2000 | Geschiere et al. | |
| 6,654,477 | B1 | 11/2003 | Miller et al. | |
| 6,658,134 | B1 | 12/2003 | van Hal et al. | |
| 6,757,403 | B2 | 6/2004 | Urushibata et al. | |
| 7,050,602 | B2 | 5/2006 | Miller | |
| 7,103,196 | B2 | 9/2006 | Warren | |
| 7,164,776 | B2 | 1/2007 | Miller et al. | |
| 7,203,334 | B2 | 4/2007 | Schafer et al. | |
| 7,236,609 | B1 | 6/2007 | Tsangaris et al. | |
| 7,321,664 | B2 | 1/2008 | Van Banning et al. | |
| 7,336,797 | B2 | 2/2008 | Thompson et al. | |
| 7,362,878 | B2 | 4/2008 | Miller et al. | |
| 7,366,317 | B2 | 4/2008 | Miller et al. | |
| 7,415,125 | B2 | 8/2008 | Warren et al. | |
| 7,443,997 | B2 | 10/2008 | Miller et al. | |
| 7,817,815 | B2 | 10/2010 | Miller | |
| 7,860,264 | B2 | 12/2010 | Jiles et al. | |
| 7,921,540 | B2 | 4/2011 | Jiles et al. | |
| 7,925,041 | B2 | 4/2011 | Jiles et al. | |
| 7,995,789 | B2 | 8/2011 | Tsangaris et al. | |
| 8,027,492 | B2 | 9/2011 | Miller | |
| 8,233,646 | B2 | 7/2012 | Lutz et al. | |
| 8,494,209 | B2 | 7/2013 | Miller et al. | |
| 8,824,726 | B2 | 9/2014 | Miller et al. | |
| 8,837,755 | B2 | 9/2014 | Jiles et al. | |
| 9,137,605 | B2 | 9/2015 | Manley et al. | |
| 9,137,610 | B2 | 9/2015 | Jiles et al. | |
| 10,945,077 | B2 | 3/2021 | Scheleski et al. | |
| 2002/0003890 | A1 | 1/2002 | Warren et al. | |
| 2006/0140436 | A1 | 6/2006 | de Moel et al. | |
| 2006/0239488 | A1 | 10/2006 | Geschiere et al. | |
| 2007/0036378 | A1 | 2/2007 | Saltykov et al. | |
| 2009/0147983 | A1 | 6/2009 | Jiles | |
| 2010/0054509 | A1 | 3/2010 | Thompson | |
| 2010/0284561 | A1* | 11/2010 | Miller | H04R 11/02 381/418 |
| 2012/0008814 | A1 | 1/2012 | Alwicker et al. | |
| 2012/0286865 | A1 | 11/2012 | Chandrasekaran | |
| 2013/0279732 | A1 | 10/2013 | Sanecki et al. | |
| 2014/0369548 | A1 | 12/2014 | Manley et al. | |
| 2015/0036831 | A1 | 2/2015 | Klippel | |
| 2015/0086049 | A1 | 3/2015 | Jiles | |
| 2015/0110338 | A1 | 4/2015 | McCratic et al. | |
| 2015/0201293 | A1 | 7/2015 | Sanecki et al. | |
| 2015/0249889 | A1 | 9/2015 | Iyer et al. | |
| 2015/0373456 | A1 | 12/2015 | Dayton et al. | |
| 2016/0227328 | A1 | 8/2016 | Van Halteren et al. | |
| 2018/0367916 | A1* | 12/2018 | Tjepkema | H04R 25/60 |
| 2019/0007768 | A1 | 1/2019 | Kim | |
| 2019/0069091 | A1* | 2/2019 | Bruins | H04R 7/04 |
| 2019/0306610 | A1 | 10/2019 | Kim | |
| 2019/0320272 | A1* | 10/2019 | Jones | H04R 25/604 |
| 2020/0154212 | A1 | 5/2020 | Mbahri et al. | |

FOREIGN PATENT DOCUMENTS

| | | | |
|---|---|---|---|
| CN | 203840067 | U | 9/2014 |
| CN | 203840177 | U | 9/2014 |
| CN | 203840179 | U | 9/2014 |
| CN | 203840180 | U | 9/2014 |
| CN | 203872027 | U | 10/2014 |
| CN | 203933199 | U | 11/2014 |
| CN | 203951282 | U | 11/2014 |
| CN | 203951286 | U | 11/2014 |
| CN | 204046390 | U | 12/2014 |
| CN | 204046391 | U | 12/2014 |
| CN | 204118999 | U | 1/2015 |
| CN | 204119001 | U | 1/2015 |
| CN | 204168459 | U | 2/2015 |
| CN | 204291354 | U | 4/2015 |
| CN | 204350281 | U | 5/2015 |
| CN | 204350282 | U | 5/2015 |
| CN | 204350283 | U | 5/2015 |
| CN | 204350284 | U | 5/2015 |
| CN | 204350285 | U | 5/2015 |
| CN | 204350286 | U | 5/2015 |
| CN | 105050010 | A | 11/2015 |
| CN | 205584474 | U | 9/2016 |
| CN | 205595924 | U | 9/2016 |
| CN | 205595999 | U | 9/2016 |
| CN | 205596313 | U | 9/2016 |
| CN | 107135449 | A | 9/2017 |
| CN | 107222818 | A | 9/2017 |
| CN | 107240976 | A | 10/2017 |
| CN | 107240989 | A | 10/2017 |
| CN | 107241674 | A | 10/2017 |
| CN | 203951601 | U | 11/2017 |
| CN | 206775740 | U | 12/2017 |
| CN | 206879090 | U | 1/2018 |
| CN | 207354540 | U | 5/2018 |
| EP | 0993759 | B1 | 10/2001 |
| EP | 0784415 | B1 | 8/2002 |
| EP | 1247427 | B1 | 11/2003 |
| FR | 551182 | | 3/1923 |
| FR | 564941 | | 10/1923 |
| GB | 859830 | A | 1/1961 |
| JP | 2007074499 | A | 3/2007 |
| JP | 4876293 | B2 | 2/2012 |
| WO | 2015057519 | A1 | 4/2015 |
| WO | 2016058637 | A | 4/2016 |

* cited by examiner

BALANCED ARMATURE RECEIVER HAVING IMPROVED SHOCK PERFORMANCE

FIELD OF THE DISCLOSURE

The present disclosure relates generally to balanced armature (BA) receivers and more particularly to nickel-iron (Ni—Fe) alloy armature having improved robustness and performance for BA receivers, as well as to BA motors and BA receivers comprising such Ni—Fe alloy armatures.

BACKGROUND

BA receivers (also referred to herein as "receivers") capable of producing an acoustic output signal in response to an electrical audio signal are commonly used in hearing aids, wired and wireless earphones, True Wireless Stereo (TWS) devices, among other hearing devices. BA receivers generally comprise a housing in the form of a cup and cover enclosing a diaphragm that separates an interior of the housing into a back volume and a front volume. An electromagnetic motor located in the back volume includes an electrical coil disposed about an armature (also referred to herein as a "reed") having a free end portion movably disposed between permanent magnets retained by a yoke. A drive rod or other link mechanically connects the movable portion of the reed to a movable portion of the diaphragm known as a paddle. The reed vibrates between the magnets in response to an electrical signal (representing sound) applied to the coil; otherwise, the reed is balanced between the magnets. The moving diaphragm expels sound out of a sound port of the housing via the front volume.

The motor and particularly the reed and yoke of known balanced armature receivers comprise ASTM A753-2 Type 2 (UNS K94840) nickel-iron (Ni—Fe) alloy having a nickel content between 47% and 49% by weight. Type 2 Ni—Fe alloy is desired for its characteristically low coercivity, low core loss, low distortion and high magnetic permeability. ASTM A753-02 Type 1 (UNS K94490) Ni—Fe alloy has a lower nickel content than Type 2 Ni—Fe alloy. Type 1 Ni—Fe alloy has not been used for armatures due to its low magnetic permeability and high coercivity compared to Type 2 Ni—Fe alloy. However Type 2 Ni—Fe alloy is relatively inelastic and susceptible to plastic deformation, which can result from an impact or other shock imparted to the receiver. A bent or otherwise deformed reed adversely affects the acoustical performance of the receiver. Thus there is a desire to provide BA receivers, and motors and armatures for such receivers that are more robust.

BRIEF DESCRIPTION OF THE DRAWINGS

The objects, features and advantages of the present disclosure will become more fully apparent from the following detailed description and the appended claims considered in conjunction with the accompanying drawings. The drawings depict only representative embodiments and are therefore not considered to limit the scope of the disclosure.

Those of ordinary skill in the art will appreciate that the figures are illustrated for simplicity and clarity and therefore may not be drawn to scale and may not include well-known features, that the order of occurrence of actions or steps may be different than the order described or be performed concurrently unless specified otherwise, and that the terms and expressions used herein have the meaning understood by those of ordinary skill in the art except where different meanings are attributed to them herein.

DETAILED DESCRIPTION

The disclosure relates generally to balanced armature receivers and more particularly to armatures comprising nickel-iron (Ni—Fe) alloy compositions having improved robustness and performance for BA receivers. The disclosure also related to receiver motors and receivers comprising such armatures. BA receivers are commonly used in hearing aids, wired and wireless earphones, True Wireless Stereo (TWS) devices, among other hearing devices that are susceptible to shock when handling or dropped.

A balanced armature receiver generally comprises a housing having a sound port between an interior and exterior thereof, and a diaphragm disposed in the housing and separating the interior thereof into a front volume and a back volume. A motor disposed at least partially within the housing comprises a coil located proximate an armature having a free-end portion balanced between permanent magnets retained by a yoke. The free-end portion of the armature is connected to a movable portion of the diaphragm and vibrates between the magnets in response to an audio signal applied to the coil, whereby the moving diaphragm emits sound from the sound port. A representative balanced armature receiver is described in greater detail below.

Figure 1:
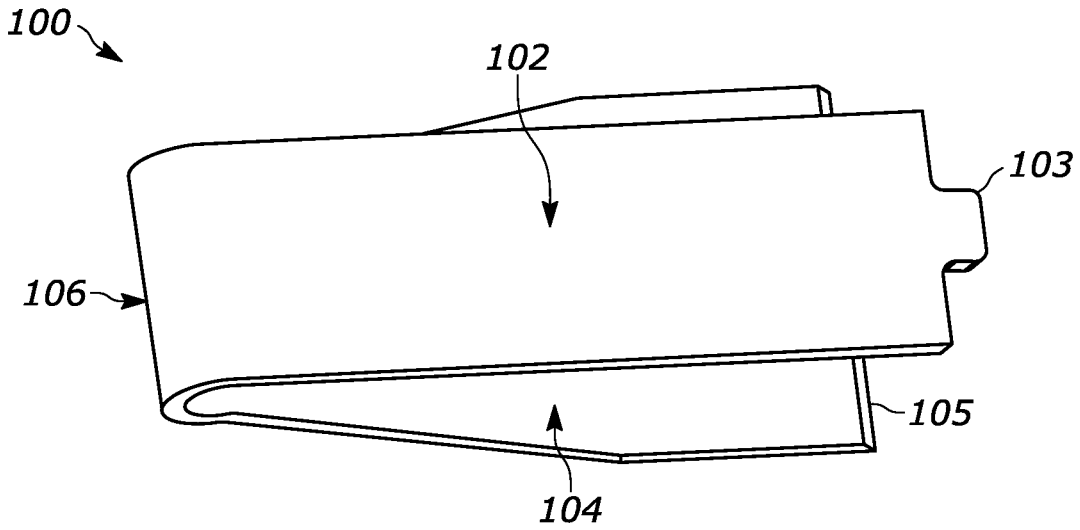
FIG. 1 is a representative balanced armature receiver U-reed.
Figure 2:
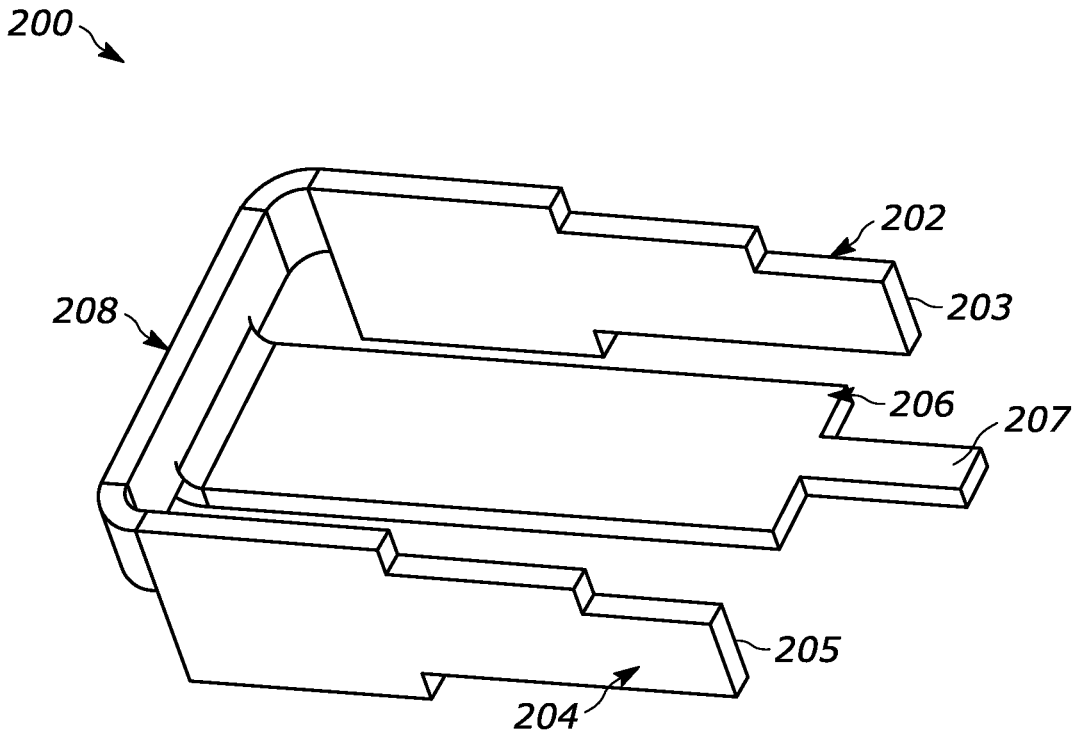
FIG. 2 is a representative balanced armature receiver E-reed.

The Ni—Fe alloy armatures described herein can take many forms. Most all of these armatures generally comprise a planar member having a longitudinal dimension, a width dimension transverse to the longitudinal dimension, and a thickness dimension less than the width dimension. An end portion of the planar member is positionable between magnets retained by a yoke when the armature is connected to the yoke. In one implementation, shown in FIG. 1, the armature is a U-reed 100 comprising a first portion 102 and second portion 104 connected by a U-portion 106. The first portion of the armature 100 corresponds to the planar member and includes a movable end portion 103 connectable to a diaphragm of the receiver. The second portion includes an end portion 105 connectable to a yoke of the receiver. In another implementation, shown in FIG. 2, the armature is an E-reed 200 comprising a first arm 202 and second arm 204 located on opposite sides of a central arm 206 corresponding to the planar member. The central arm includes a movable end portion 207 connectable to the diaphragm. The first, second and central arms each have a corresponding end portion connected to a common base portion 208. The first and second arms have opposite end portions 203, 205, respectively, connectable to the yoke. Other armatures suitable for use in balanced armature receivers have other shapes and structures. These and other armature configurations can be fabricated in stamping and forming operations and can comprise a unitary structure or can be an assembly of components. The armature can also have other known or future structural configurations.

According to one aspect of the disclosure, generally, the armature is a nickel-iron (Ni—Fe) alloy comprising a nickel content of 45% or less by weight, 5% or less additives and impurities by weight, and the balance Fe. This representative Ni—Fe alloy armature has a modulus of elasticity not greater than 120 gigapascals (GPa), a density of less than 8.20 g/cm^3, and a yield strain, after annealing, of 0.001 or greater.

The mechanism of elastic deformation in a reed is dominating by bending, which includes tensile, compressive, and shear stresses and strains. As such, the effective modulus seen in bending, also called the flexural modulus, may differ slightly from the more commonly measured tensile modulus. For the purposes of this disclosure, the terms bending modulus, flexural modulus, Young's modulus, effective elastic modulus, elastic modulus, and modulus of elasticity are all understood to mean the material property that dictates the stress-strain relationship of the reed in operation and during shock events. Similarly, for the purposes of this disclosure, the term yield strain is used interchangeably to refer to the strain seen in tension, compression, bending, or combined modes of deflecting the reed.

In a more particular implementation, the armature is a Ni—Fe alloy comprising a nickel content between 36.5% and 45% by weight, 5% or less additives and impurities by weight and the balance Fe. In this implementation, the Ni—Fe alloy armature has a modulus of elasticity between 80 GPa and 120 GPa, a density between 8.1 g/cm^3 and 8.20 g/cm^3, and a yield strain, after annealing, between 0.001 and 0.004.

In another more particular implementation, the armature is a Ni—Fe alloy comprising a nickel content between 38.5% and 41.5%, 2% or less additives and impurities by weight, and the balance Fe. In this implementation, the Ni—Fe alloy armature has a modulus of elasticity between 80 GPa and 100 GPa, a density between 8.10 g/cm^3 and 8.15 g/cm^3, and a yield strain, after annealing, between 0.002 and 0.003.

Figure 3:
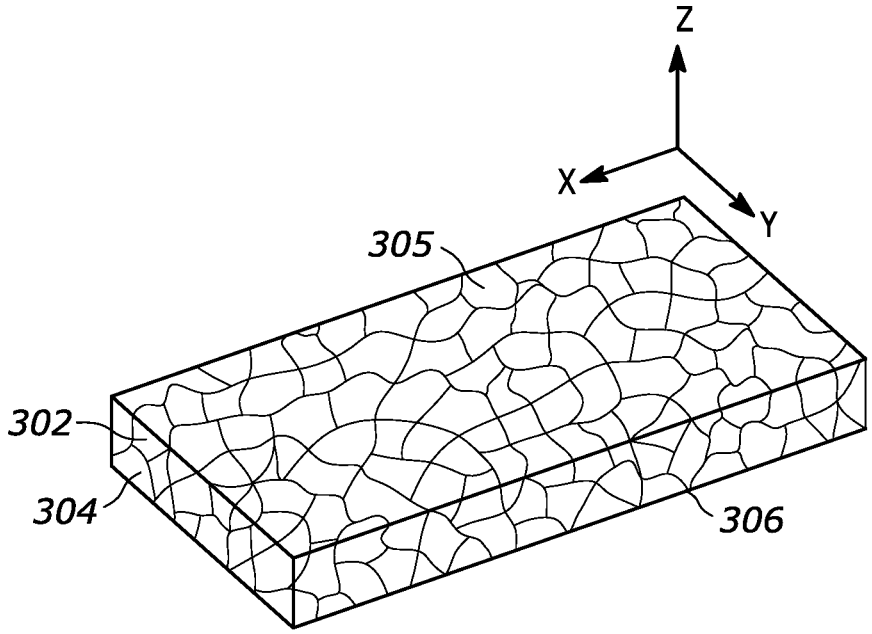
FIG. 3 is a representative receiver armature having multiple grains across a thickness dimension of the armature.
Figure 4:
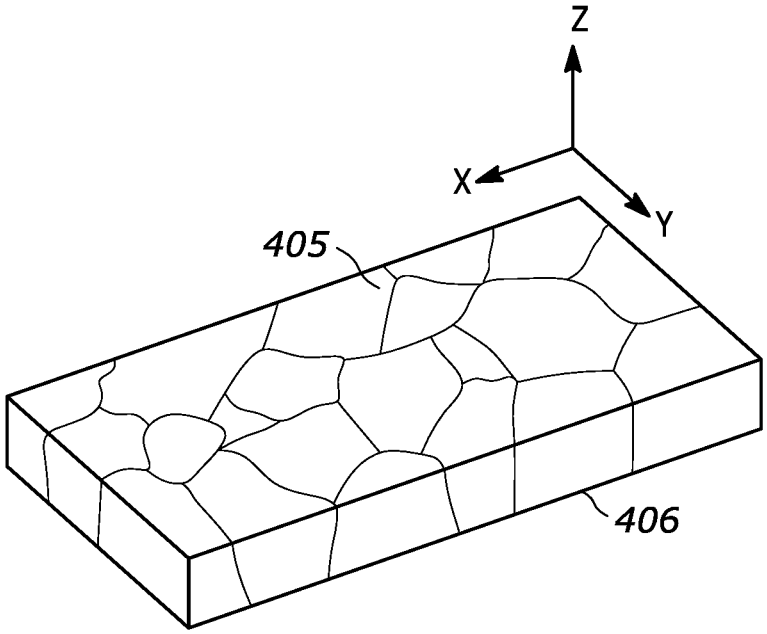
FIG. 4 is a representative receiver armature having a single grain across a thickness dimension of the armature.

According to another aspect of the disclosure, the Ni—Fe alloy armature comprising a nickel content of 45% or less by weight is subject to an annealing operation after formation of the armature. Ni—Fe alloy material as delivered from a steel mill tends to have small grains before annealing. FIG. 3 shows a Ni—Fe alloy strip material having relatively small grains 302, 304 between opposite side surfaces 305, 306 prior to annealing. Small grain size improves the workability of the Ni—Fe alloy material during formation (e.g., stamping, bending . . . ) of the armature. A typical armature has a thickness between 100 microns and 200 microns. After the Ni—Fe material is formed into an armature it will be annealed to improve the magnetic properties of the armature. During the anneal process the grains will grow in size and provide improved magnetic properties at the expense of some mechanical properties. Generally, the average grain size of the Ni—Fe alloy armature depends on the annealing temperature and time duration, armature thickness and other factors. According to this aspect of the disclosure, a fully annealed Ni—Fe armature comprises a grain size generally greater than 100 micron and possibly as high as 400 microns. In FIG. 4, the annealed armature has many relatively large grains that are as thick as, or thicker than, the thickness of the armature in the z-direction.

Figure 5:
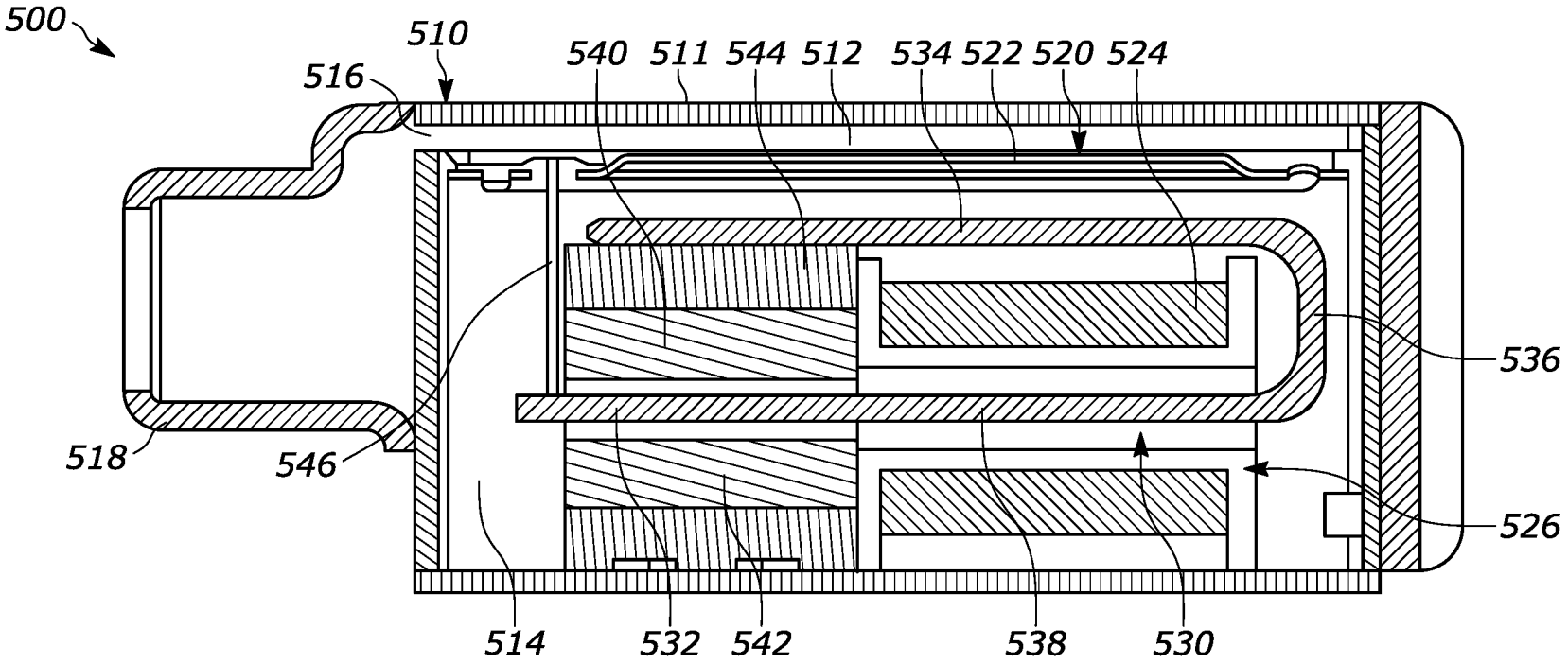
FIG. 5 is a cross-sectional view of a balanced armature receiver.

FIG. 5 is a representative balanced armature receiver 500 comprising an armature having a Ni—Fe alloy as described herein. The various armatures comprising the Ni—Fe alloy described herein can be used in the receiver of FIG. 5 as well as in other known or future BA receivers. In FIG. 5, the receiver 500 comprises a housing 510, a diaphragm 520 disposed within a housing and separating an interior thereof into a front volume 512 and a back volume 514. The front volume is acoustically coupled to an exterior of the housing via a sound port 516 located on an end wall portion. Alternatively, the sound port can be located on some other part of the housing, for example on a wall portion parallel to the diaphragm, among others. The representative receiver also includes a nozzle 518 disposed over the sound port and coupled to an end wall on which the sound port is located. Other receivers do not include a nozzle. The sound port can be located on different wall portion of the housing. For example, the sound port can be located on a wall portion 511 parallel to the diaphragm and partially defining the front volume. Alternatively, the sound port can be on a wall portion defining another part of the interior of the housing.

In FIG. 5, a motor disposed in the back volume comprises a coil 524 supported by a bobbin 526 located about an armature 530 having a free-end portion 532 movably located between permanent magnets 540, 542 retained in space apart relation by a yoke 544. The free-end portion of the armature is coupled to a movable portion of the diaphragm known as a paddle 522 by a drive rod or other link 546. The armature in FIG. 5 is a U-reed having a first arm 534 coupled to the yoke and a second arm 538 from which the free-end portion 532 extends. A U-portion 536 of the armature interconnects the first and second arms. The receiver generally comprises a terminal located on an outer portion or surface of the housing. The terminal includes contacts electrically coupled to the coil within the housing, wherein the contacts are accessible from an exterior of the receiver. Other receivers can have a variety of other forms. For example, the armature can be an E-reed or have some other configuration, the bobbin is not required, and the motor can be located in the front volume instead of the back volume, among other known and future balanced armature designs.

In some receiver implementations, the armature and yoke both comprise the same Ni—Fe composition, namely a nickel content of 45% or less by weight as described herein. In other receiver implementations, however, a Ni—Fe alloy yoke comprises a different nickel content than the Ni—Fe alloy armature described in the embodiments disclosed herein. The yoke does not require enhanced strain characteristics to survive a shock as it is physically well constrained by magnets, reed welding and case. The yoke only requires optimized for magnetic properties. Type 2 Ni—Fe alloys provide the best magnetic properties for the yoke. The reed must balance magnetic properties with elastic modulus and resistance to damage when larger strains occur during shock events. In one particular implementation, the armature is a Ni—Fe alloy comprising a nickel content of 45% or less by weight and the yoke is a Ni—Fe alloy comprising a nickel content between 46% and 51% by weight. For example, the yoke can be a Type 2 Ni—Fe alloy comprising a nickel content between 47% to 49% by weight.

While the disclosure and what is presently considered to be the best mode thereof has been described in a manner establishing possession and enabling those of ordinary skill in the art to make and use the same, it will be understood and appreciated that there are many equivalents to the representative embodiments described herein and that myriad modifications and variations may be made thereto without departing from the scope and spirit of the invention, which is to be limited not by the embodiments described but by the appended claims and their equivalents.

What is claimed is:

1. A balanced armature receiver armature comprising:

a planar member having a longitudinal dimension, a width dimension transverse to the longitudinal dimension, and a thickness dimension less than the width dimension, an end portion of the planar member positionable between magnets retained by a yoke of a balanced armature receiver when the armature is connected to the yoke, the balanced armature receiver armature is a nickel-iron (Ni—Fe) alloy comprising a nickel content of 45% or less by weight, 5% or less additive and impurities by weight, and the balance Fe.

2. The balanced armature receiver armature of claim 1, wherein the Ni—Fe alloy armature has a modulus of elasticity not greater than 120 gigapascals (GPa).

3. The balanced armature receiver armature of claim 2, wherein the Ni—Fe alloy armature has a density less than 8.20 g/cm^3.

4. The balanced armature receiver armature of claim 3, wherein the Ni—Fe alloy armature has a yield strain of 0.001 or greater.

5. The balanced armature receiver armature of claim 1, wherein the Ni—Fe alloy armature has a nickel content between 36.5% and 45% by weight.

6. The balanced armature receiver armature of claim 5, wherein the Ni—Fe alloy armature has a modulus of elasticity between 80 GPa and 120 GPa.

7. The balanced armature receiver armature of claim 6, wherein the Ni—Fe alloy armature has a density between 8.1 g/cm^3 and 8.2 g/cm^3.

8. The balanced armature receiver armature of claim 7, wherein the Ni—Fe alloy armature has a yield strain between 0.001 and 0.004.

9. The balanced armature receiver armature of claim 1, wherein the Ni—Fe alloy armature has a nickel content between 38.5% and 41.5% by weight, 2% or less additives and impurities by weight, and the balance Fe.

10. The balanced armature receiver armature of claim 9, wherein the Ni—Fe alloy armature has a modulus of elasticity between 80 GPa and 100 GPa.

11. The balanced armature receiver armature of claim 10, wherein the Ni—Fe alloy armature has a density between 8.1 g/cm^3 and 8.15 g/cm^3.

12. The balanced armature receiver armature of claim 11, wherein the Ni—Fe alloy armature has a yield strain between 0.002 and 0.003.

13. The balanced armature receiver armature of claim 10, wherein the Ni—Fe alloy armature has an average grain size between 100 microns and 400 microns.

14. The balanced armature receiver armature of claim 1, wherein the Ni—Fe alloy armature comprises single grains through the thickness dimension.

15. The balanced armature receiver armature of claim 14, wherein the Ni—Fe alloy armature has an average grain size greater than 100 micron.

16. The balanced armature receiver armature of claim 1, wherein the balanced armature receiver armature constitutes a portion of a motor comprising:

an electrical coil disposed about a portion of the armature;

a yoke connected to a portion of the armature;

two permanent magnets retained in spaced apart relation by the yoke, the free-end of the armature movably located between the magnets.

17. The balanced armature receiver armature of claim 16, wherein the yoke is a Ni—Fe alloy comprising a nickel content greater than 46% by weight.

18. The balanced armature receiver armature of claim 17, constitutes a portion of a balanced armature receiver comprising a housing having a sound port between an interior and exterior of the housing; a diaphragm disposed in the housing and separating the interior into a front volume and a back volume, the sound port coupled to the front volume; the motor disposed in the housing; and a link connecting the free-end portion of the armature to a movable portion of the diaphragm.

19. The balanced armature receiver armature of claim 16, wherein the yoke is a Ni—Fe alloy comprising a nickel content between 46% and 51% by weight.

* * * * *